US012349744B2

(12) United States Patent
Burns

(10) Patent No.: US 12,349,744 B2
(45) Date of Patent: Jul. 8, 2025

(54) DYNAMIC FUNCTION FASHION TAPE AND METHODOLOGY

(71) Applicant: Julia Ann Burns, New York, NY (US)

(72) Inventor: Julia Ann Burns, New York, NY (US)

( * ) Notice: Subject to any disclaimer, the term of this patent is extended or adjusted under 35 U.S.C. 154(b) by 50 days.

(21) Appl. No.: 18/229,536

(22) Filed: Aug. 2, 2023

(65) Prior Publication Data

US 2024/0032613 A1 Feb. 1, 2024

Related U.S. Application Data

(63) Continuation of application No. 17/814,230, filed on Jul. 21, 2022, now Pat. No. 11,779,061.

(60) Provisional application No. 63/203,416, filed on Jul. 21, 2021.

(51) Int. Cl.
*A41C 3/00* (2006.01)

(52) U.S. Cl.
CPC ..... *A41C 3/005* (2013.01)

(58) Field of Classification Search
CPC ..... A41C 3/0065; A41C 3/06; A41C 3/005
USPC ..... 450/81
See application file for complete search history.

(56) References Cited

U.S. PATENT DOCUMENTS

| | | | | |
|---|---|---|---|---|
| 9,703,797 | B2 * | 7/2017 | Therrien | G06F 16/1756 |
| 11,425,941 | B1 * | 8/2022 | Connelly | A41C 3/144 |
| 11,779,061 | B1 * | 10/2023 | Burns | A41C 3/065 450/81 |
| 2017/0105459 | A1 * | 4/2017 | Eilemberg | A41C 3/0007 |
| 2018/0027886 | A1 * | 2/2018 | Kratsa | A41C 3/065 |
| 2019/0200681 | A1 * | 7/2019 | Karon | A41C 3/065 |
| 2019/0328049 | A1 * | 10/2019 | Casady | A41C 3/0078 |
| 2020/0205486 | A1 * | 7/2020 | O'Leary | A41C 3/12 |
| 2022/0279868 | A1 * | 9/2022 | Wylde | C09J 7/21 |

* cited by examiner

*Primary Examiner* — Gloria M Hale
(74) *Attorney, Agent, or Firm* — David L. Cohen

(57) ABSTRACT

An engineered adhesive fashion tape element comprising a constructed dynamic function includes a multilayered embodiment with strategically placed predetermined predisposed direction and designed with multilayered materials, a modern dynamic function solution lifting projecting and supporting a user's breast tissue and body tissue to defy gravity for a sustained period while wearing and functioning with daily activities. An adhesive tape and methodology to replace wearing a bra, for a healthier and improved solution so the user can have an alternative to wearing an underwire bra, and traditional bra, shapewear, breast tissue and body tissue shaping structure. An improved alternative to wearing an adhesive bra cup and shaping garments with a variety of fashion which achieves projection lift support and defies gravity for the breast tissue and body tissue.

10 Claims, 15 Drawing Sheets

DYNAMIC FUNCTION FASHION TAPE AND METHODOLOGY

CROSS-REFERENCE TO RELATED DOCUMENTS

The present invention is a continuation application of U.S. application Ser. No. 17/814,230, filed Jul. 21, 2022, which claims priority to U.S. Provisional Patent Application No. 63/203,416 filed on Jul. 21, 2021, all of which are included herein at least by reference.

BACKGROUND

Prior Art

The following is a tabulation of some prior art that presently appears relevant:

| U.S. Pat. | | | |
|---|---|---|---|
| Pat. No. | Kind Code | Issue Date | Patentee |
| 2,553,825 | | 1951 May 22 | Langs |
| 2,596,567 | | 1952 May 13 | Langs |
| 3,276,449 | | 1966 Oct. 4 | Morgan |
| 3,434,478 | | 1969 Mar. 25 | Liebowitz et al. |
| 3,934,593 | | 1976 Jan. 27 | Mellinger |
| 4,343,313 | | 1982 Aug. 10 | LeJeune |
| 5,454,635 | | 1995 Oct. 17 | Berman |
| 7,229,335 | B2 | 2007 Jun. 12 | Davis |
| 6,645,042 | B2 | 2003 Nov. 11 | Davis |
| 10869776 | B2 | 2020 Dec. 22 | Hahn et al. |
| 11160316 | B2 | 2021 Nov. 2 | O'Leary |
| 6,371,831 | B1 | 2002 Apr. 16 | Dodge |
| 8,029,332 | B2 | 2011 Oct. 4 | Nadsady et al. |
| 7,001,421 | B2 | 2006 Feb. 21 | Gorringer et al. |
| 10638799 | B2 | 2020 May 5 | Karon et al. |
| 8,371,902 | B2 | 2013 Feb. 12 | Sherwood |
| D525,012 | S | 2006 Jul. 18 | Valentin |
| D539,506 | S | 2007 Apr. 3 | Valentin |
| D555,329 | S | 2007 Nov. 20 | Valentin |
| D575,927 | S | 2008 Sep. 2 | Valentin |
| D485,965 | S | 2004 Feb. 3 | Slimak et al. |
| D473641 | S | 2003 Apr. 22 | Kali |

| U.S. patent application | | | |
|---|---|---|---|
| Publication Nr. | Kind Code | Publ. Date | Applicant |
| 20050282468 | A1 | 2005 Dec. 22 | Davis |
| 20100180359 | A1 | 2010 Jul. 22 | Andrews |

1. FIELD OF INVENTION

The present invention relates to bras, brassieres, breast covers, fashion tape, breast tape, shape tape, body art, body tissue lifting, bodywear, and more specifically to disposable adhesive bra solutions, bra replacements, breast tape solutions, body art solutions, engineered fashion tape, body tissue lift tape, body tissue projecting solutions, bodywear lifting, bodywear projecting solutions, shape wear solutions, body smoothing tape, body shaping tape that are dynamically functioning.

2. BACKGROUND TO THE INVENTION

There is increasing desire to find a more comfortable, pain free and healthy solution to wearing a bra and brassiere.

There is also increasing desire to find a more visually pleasing solution to wearing a bra and brassiere to wear with certain styles of clothing.

Many users have discomfort and pain in the body while wearing bras and brassieres. One example is pain coming from the user wearing an underwire bra with the underwire in the cup poking into their side and a breast tissue causing discomfort. A second example is the bra not supporting the heavy weight of some breast tissue, and a bra strap is pulling down on the shoulders from said excess weight. A third example is a support frame anchoring the bra in the best place for support, but the user may not feel comfortable with the tightness of the support frame around user's ribcage and back. The excess weight of the breast tissue also causes back pain and poor posture in many users from the excess weight in the front of the user's body being out of balance with their body. A fourth example is when a ring and slide on the bra strap which are used for adjustment of the strap, are digging into fleshy areas of a user's upper torso. These examples are a few of many reasons users find bras uncomfortable and create pain in different areas of their body.

During the time of this filing, users worldwide have enjoyed the freedom and comfort of not wearing a bra while being quarantined and working from home during the global COVID-19 pandemic. For years, users have also been wearing a bralette, a seamless bra, and other tank top style bras for increased comfort and modesty to cover the breast and nipple, however, these bralettes and bras do not offer support, performance, or dynamic function. These types of styles provide modesty and comfort but do very little, if any, to provide support or performance features for the user's breast tissue, especially as breast tissue volume increases in the user.

There is increasing desire to find a healthier solution to wearing a bra, especially a bra with an underwire. The use of underwires in bras is to assist the projection of the user's breast tissue while wearing for a feminine and sensual look to the breast tissue. Underwire in the front cup is placed on a portion of the user's breast tissue in the garment and is not extending to the lateral sides of the breast tissue. Bras with traditionally u-shaped underwires in the cup restrict the natural flow of a person's lymphatic system while wearing, including a nerve cell and a mammary gland are all impacted by the restriction of a rigid underwire while a breast's inframammary fold is shaped like a soft, rounded check mark shape and reaches underneath an armpit and is therefore a very different shape than the underwire is representing. The placement of the underwire in the front and the outer side of the breast creates pressure and therefore many times is uncomfortable, creates pain and potential health issues.

Bra straps, support frames, a hook and eye, a metal hardware and underwire all create different forms of health issues. Bra straps create pressure on the shoulders, the bra support frame many times creates discomfort when worn for extended periods of time and when ill-fitting bras are worn. A hook and eye bra closure also become uncomfortable when the hook and eye is not quality and not having sufficient padding. The metal hardware on the bra strap may contain allergy causing nickel for users, and many times create pain in the user's body if placed in certain positions on the bra strap. Users have reported sustained painful issues and health problems from each one of these parts of the bra or in entirety of wearing a bra.

There is increasing desire to find a more visually pleasing solution to wearing a bra and brassiere. Many users want the look of wearing a great fitting, lifting and supportive underwire bra without the bra straps, and support frame around the body so that they can wear a plunging neckline, an open back, a halter neckline and other open fashion styles. They also increasingly want the comfort and freedom of not wearing a bra at all. The users that love the look of an underwire bra because of enhanced cleavage from the projection and lift of the breast tissue, and more rounded shape of the breast, many times wants a more comfortable and healthier solution to a traditional underwire bra. The user wants comfort and good health but also wants a feminine and sensual look, many times cannot find an alternative solution that is providing the lift, projection, support, and function of the traditional underwire bra. Users want the option to wear clothing and fashion they love but many times a clothing style does not work with wearing a traditional bra because of plunging necklines, open back and/or other styles lines in the clothing. Users do not want a cup, support frame, strap and the closure or a fastener of the traditional bra showing in the fashion style.

It is known in the prior art to have alternative bra and brassiere solutions that are a one-time wearable adhesive bra. One method of the one-time wearable adhesive bra is shown in U.S. Pat. No. 7,229,335 B2 to Davis (2007) where a breathable member is 100% Rayon, a woven, combined with one layer of a medical grade adhesive which has apertures also known as perforations in the embodiment for the purpose of breathability. It is the outer Rayon woven with the medical grade adhesive on the back and a paper liner for backing in combination is making it slippery, tearing easily, and difficult to apply. The paper liner is issued for protecting the adhesive before application. The embodiment tears easily while the user is first removing the paper liner. The woven adhesive embodiment wrinkles very easily while applying to the breast tissue and front torso area. The wrinkles stay after applying making it ineffective. Although it is breathable due to the apertures cut into the embodiment, the apertures are also making it easier to tear and wrinkle the outer Rayon as well. It is collapsing and losing its side stability, therefore again making it an ineffective solution.

In U.S. Pat. No. 6,645,042 B2 to Davis (2003), an adhesive bra that is reusable, where the backless strapless bra with swivel snap system is a combination of 100% polyester material and a reusable silicone adhesive film inner layer embodiment. The swivel snap system is meant to swivel to create cleavage for the user. However, the snap system tears away easily from the material damaging the embodiment when trying to apply or remove from the user's breast making it ineffective. This material adhesive and snap combination flattens the breast tissue by pulling the sides of the breasts together in the center front sternum area, to create cleavage and lift, however, it is another ineffective approach and neither of the desired scenarios are working. There is no projection, no shaping, and no elevation, the embodiment is only creating a pulling mono-breast look. Depending on the weight and size of the breasts, they are falling, are not being supported, or shaped in a flattering way making it ineffective.

Another method of the one-time wearable adhesive bra is found in U.S. Pat. No. 6,371,831 to Dodge (2002) wherein the fabric and adhesive tape combination is made for an alternative strapless swimsuit top. Dodge created an adhesive swimsuit top to adhere to the breast for an adhesive-free nipple area. One problem is an areola and a nipple are not uniformly located on breast tissue, often being in different positions from one breast to another for each person making this an ineffective solution.

In a desperate approach to find a solution to not wearing the bra, the industry is using a kinesiology tape as a solution to tape the breast, however it is invented for a different purpose and therefore not performing for the way it is desired and intended.

In U.S. Pat. No. 10,869,776 B2 to Hahn et al. (2020), the patent for kinesiology tape, which is currently being used, marketed, and patented as bra solutions from other inventors should be explained first. The kinesiology tape, a sport and physical therapy tape, was originally invented to heal and support the biochemical process in the body for humans and animals to engage with the body movement and influence certain biochemical processes such as the production of steroids. As stated in '776 B2, "Kinesiology tape may be elastic and stretchable in only one direction along an axis, which is typically along a length of the tape. Kinesiology tape may be stretched when it is applied to the skin and there may be a resulting tension in the tape that lifts the skin. Kinesiology tape may provide some support and stability. Kinesiology tape may create neuromuscular feedback which increases proprioception. Various taping techniques may tend to either relax muscles or create stronger firing of muscles". Relaxed muscles and stronger firing of muscles renders this ineffective as a bra solution because it does not hold breast tissue in one place. The breast is still engaging with the body's movements and with gravity making this another ineffective solution for wearing a bra.

In U.S. Pat. No. 11,160,316 B2 to O'Leary (2021) another method of a "one-time wearable brassiere for supporting and lifting breasts", is another invention to adhesive bra solutions on the market and is made of the above listed sport and physical therapy kinesiology tape. The embodiment pictured and described in '316 B2, is a large "pear-shaped" embodiment which temporarily covers the nipple and breast tissue. This has more of a natural feel for the skin and is softer than the previous versions of adhesive solutions mentioned above that are paper-like and tear easily. The kinesiology tape conforms better to the body and does not tear; however, it is very flattening to the breast and creates undesired side breast bulges, these problems increase as the breast size increases. The "pear-shaped stretchable woven fabric" squishes the breast in an awkward, undesired shape. The large "pear-shaped" embodiment flattens the breast, like a large nipple cover, that lifts the breast to a certain extent because it pulls on the upper breast skin area towards a collar bone and depending on the weight of the breast tissue, it elevates it somewhat. This is very unflattering and creating a masculine look with side breasts and back fat especially in the bigger sizes because it is distributing the breast tissue in a lateral way because the breast tissue itself is placed in a more oblong shape reaching from the sternum to underneath an armpit on the body. O'Leary is using the "pear-shaped" embodiment in combination with the kinesiology tape sold on a roll, as in '776 B2. Only when you apply additional cuttable kinesiology tape, which you must figure out and cut it yourself to apply it along the side of the breast tissue along an underarm towards a shoulder, you can cover the side breast bulge, and push the breast more towards the front sternum. Besides it not being pretty and feminine on the body because of the forementioned performance issues it is also leaving a lot of room for failure while the user is applying. Again, this is a lot of unnecessary, frustrating work and multiple products to create a look, that may not deliver the promise solution making it a less than effective product again.

In U.S. Pat. No. 10,638,799 B2 to Karon et al. (2020), "strapless and backless brassiere" for lifting and holding larger breasts in position, another one-time wearable bra. This invention improves the wrinkling issue found in earlier inventions with a plurality of tabs at the upper portion of the embodiment, and a plurality of scallops at the bottom portion of the embodiment but it does not solve it completely. It is improving forming around the roundness of the breast tissue because of the openings at the top. However, the plurality of tabs at the top which is meant to accommodate the volume and shape of the breast with this 2-dimensional embodiment is still creating an uneven surface with wrinkles around a bust point nipple area, which is the tip of a breast's projection and therefore will show everything, disturbing the desired look, especially under a piece of tight clothing. The breasts are still placed very far apart depending on the user's body shape and breast weight or volume. This invention is made of stretchable medical grade adhesive tape with one side coated as adhesive. But again, this one-time wearable adhesive bra solution is made of ultra-thin material making it more comfortable for the skin, but it is too thin and has too much stretch, so it is not able to support the weight of a larger breast making this an ineffective bra solution.

A need therefore exists for a bra solution that eliminates the above-described disadvantages and problems. Therefore, it is desirable to have a beautifully designed, comfortable, healthy, and high performing bra and brassiere solution which may or may not be seen when wearing clothes. The above disadvantages have been overcome in the present invention.

3. SUMMARY OF THE INVENTION

The present invention relates generally to dynamic function adhesive to be used in the manufacture of dynamic function fashion tape and the methodology. In particular, the invention refers to flexible material strategically placed singularly or plurally in combination with double coated medical grade adhesive strategically placed predetermined predisposed direction singularly or plurally to create the intelligence and methodology of the present invention.

In particular, the invention refers to an outer layer covering in strategically predetermined predisposed directional placement singularly or plurally and incorporating medical grade adhesive in strategically predetermined predisposed directional placement singularly or plurally in combination to create layers of a one-time wearable dynamic function fashion tape and the methodology for the purpose of creating a performance solution. The performance solution defies gravity shapes lifts projects and sculpts breast tissue body tissue and an area of the user's body.

Importantly, the dynamic function fashion tape and methodology of the present invention is not only visually pleasing and naturally comfortable, but it also performs dynamically and functions dynamically and fits the ideal image of any figure.

The invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth. The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Many other advantages and features of the present invention will become manifest to those versed in the art upon referring to the detailed description and the accompanying drawings in which preferred structural embodiments incorporating the principles of the present invention are shown by way of illustrative examples. The summary is not intended to limit the scope of the invention, which is defined solely by the claims attached hereto.

4. BRIEF DESCRIPTION OF FIGURES

The accompanying figures illustrate one or more embodiments of the disclosed dynamic function fashion tape and methodology with a one-time wearable adhesive bra being one possible application. These figures, together with the detailed description, explain the aspects and implementations of the apparatus and its applications. Embodiments are described in conjunction with the appended figures. The drawings are not intended to limit the scope of the present disclosure.

FIG. 1-3 is an example of the two-piece embodiment of the dynamic function fashion tape 20 with right and left sides on a reduced scale with parts separated for clarity.

FIG. **6*a* is an example of the cross section of all layers laminated together including paper liner protection, creating the embodiment of an outer flexible textile layer, inner body medical grade adhesive layer, and additional support medical grade adhesive layer, paper liner layer, as an example used in said dynamic function fashion tape 20, different flexible textile layers and support adhesive layers used in a dynamic function fashion tape 10, and a dynamic function fashion tape 40**.

Figure 7:
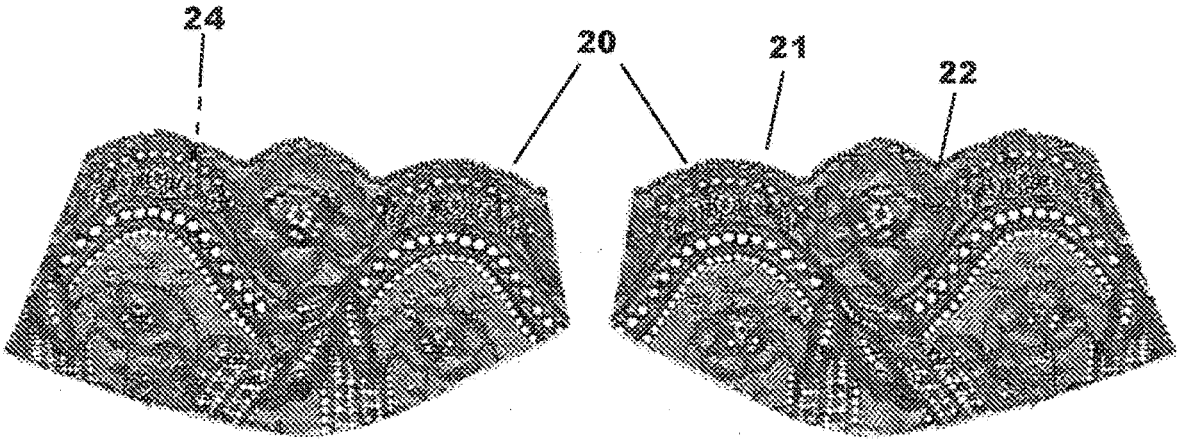

FIG. 7 is an example of an outer view of the assembled embodiment of the dynamic function fashion tape 20 in elastic lace on a reduced scale.

Figure 8:
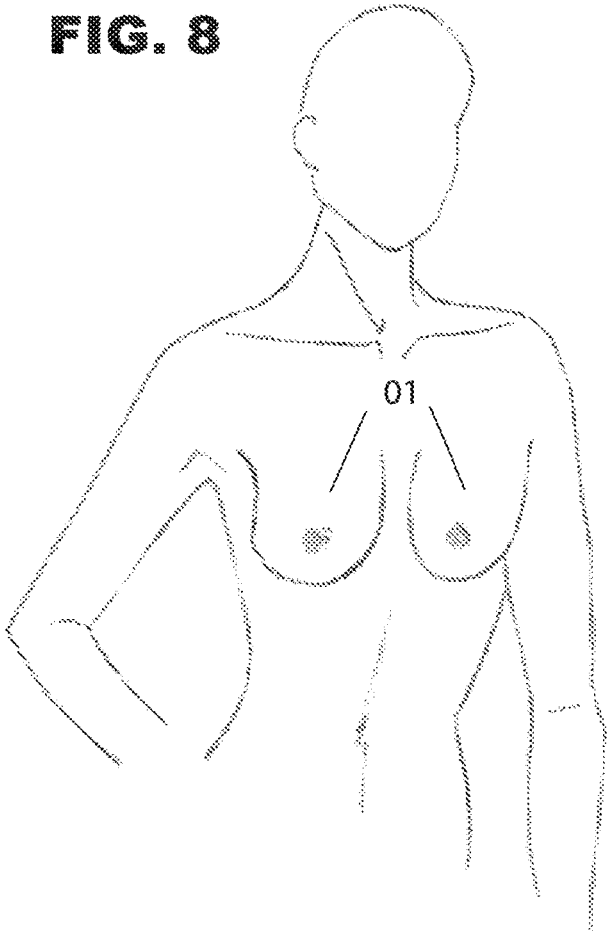

FIG. 8 is an example of a body sketch before applying the dynamic function fashion tape 20. Breasts are low, sagging and not projected. They lack a youthful breast tissue appearance.

Figure 9:
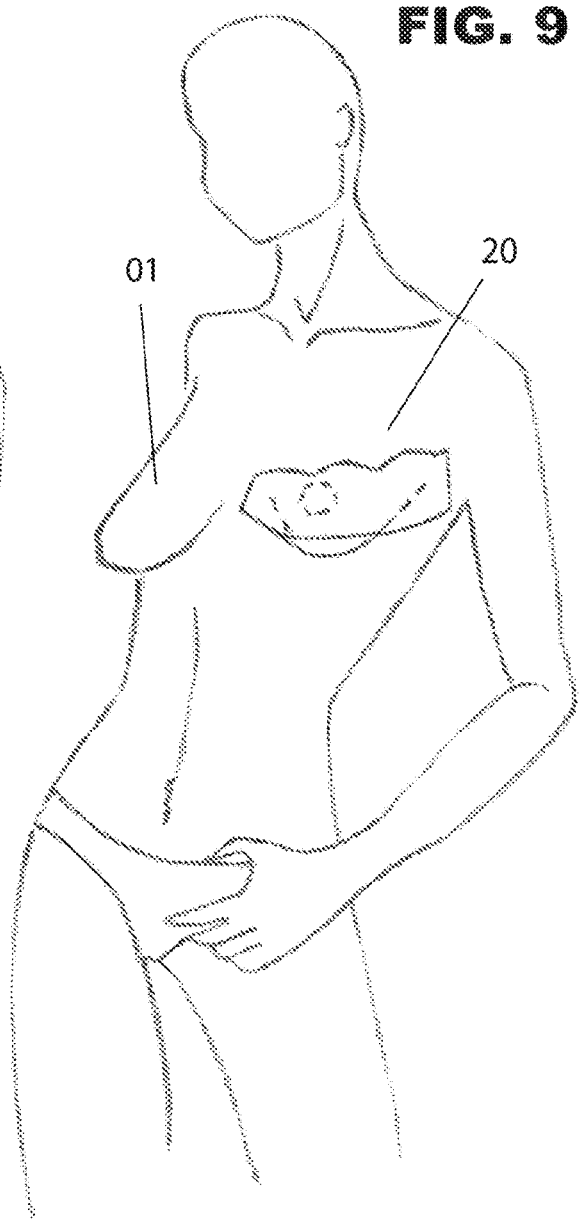

FIG. 9 is an example of an on-body sketch after applying one side of the dynamic function fashion tape 20. The dashed lines represent the areola and breast tissue underneath the fashion tape 20. One breast is lower sagging and has no projection. The other breast is lifted and projected with a feminine youthful shape.

Figure 10:
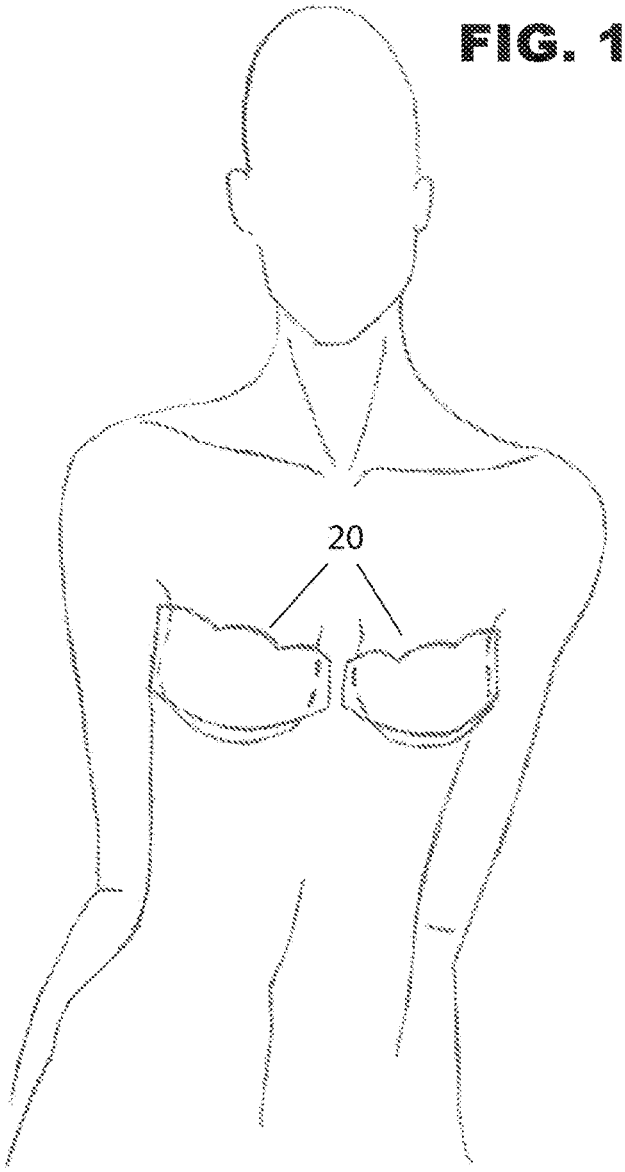

FIG. 10 is an example of the front view of an on-body sketch after applying both sides of the dynamic function fashion tape 20. The dashed lines are representing the breast tissue underneath the fashion tape 20. The wearer will also look thinner in the waistline immediately due to the flattering round lifted projected breast tissue.

Figure 11:
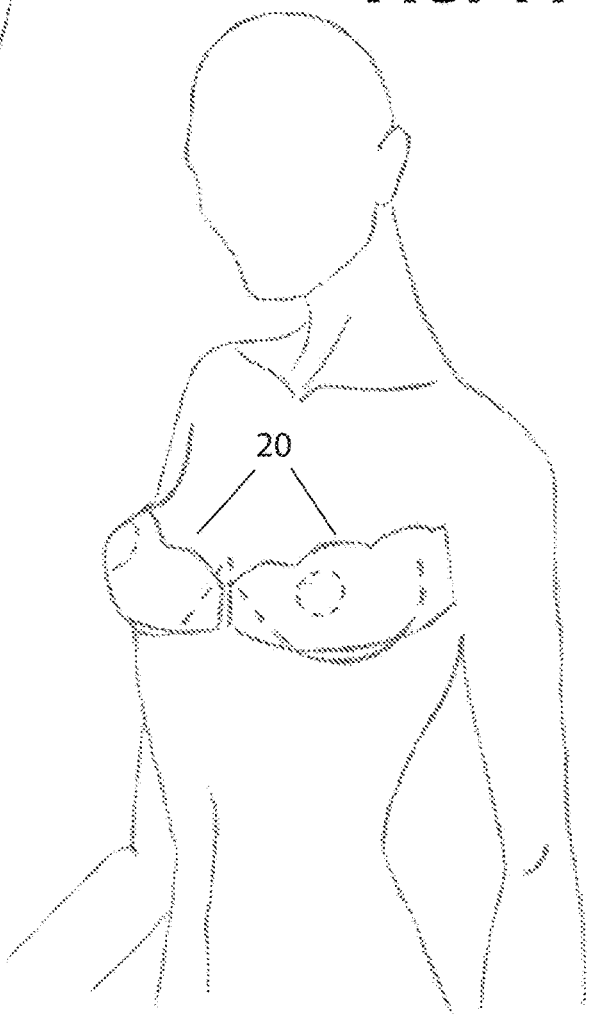

FIG. 11 is an example of a side view of an on-body sketch after applying the dynamic function fashion tape 20. The dashed lines represent the areola and breast tissue underneath the fashion tape 20 to show placement on the wearer's breast and inframammary fold.

Figure 12:
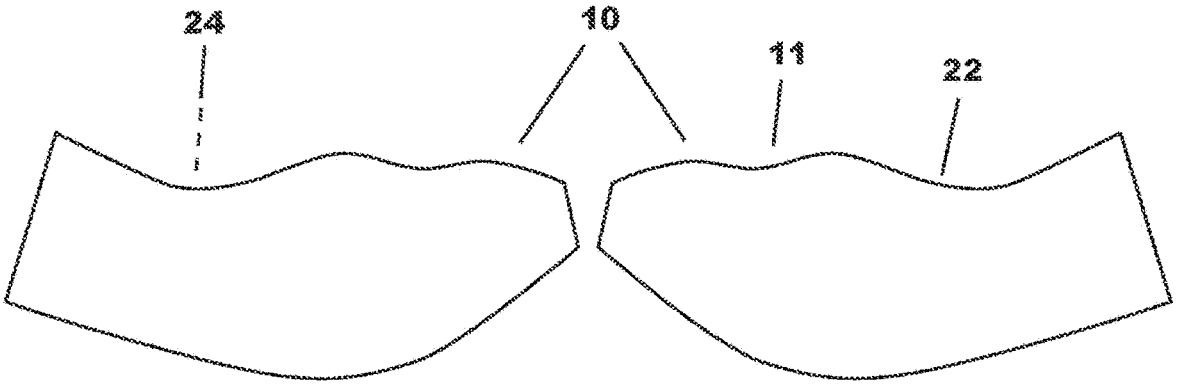

FIG. 12 is an example of an outer view of one layer of an elastic fabric of a two-piece embodiment of a dynamic function fashion tape 10 with right and left sides on a reduced scale.

Figure 13:
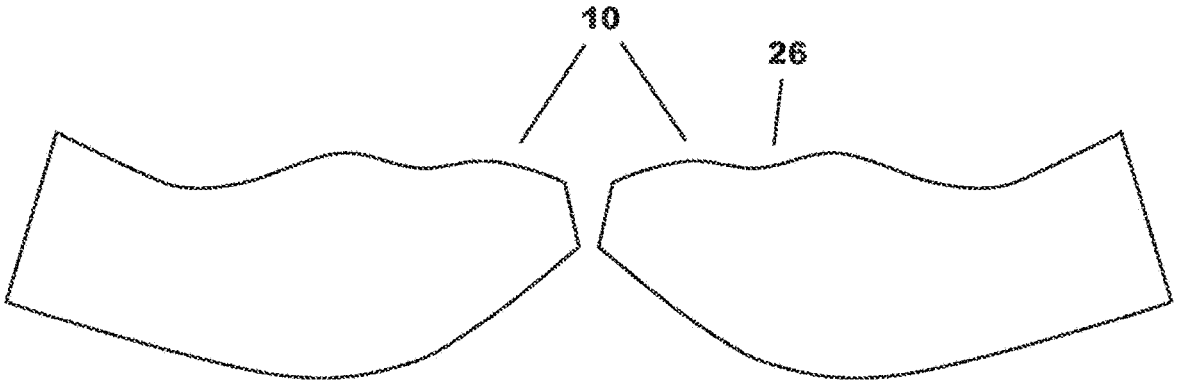

FIG. 13 is an example of an outer view of one layer of the inner body medical grade adhesive side of a two-piece embodiment of the dynamic function fashion tape 10 with right and left sides on a reduced scale.

Figure 14:
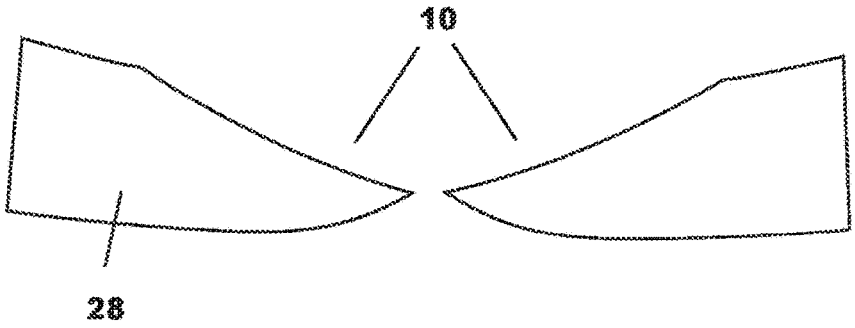

FIG. 14 is an example of an outer view of one layer of the inner side support medical grade adhesive of a two-piece embodiment of the dynamic function fashion tape 10 with right and left sides on a reduced scale.

Figure 15:
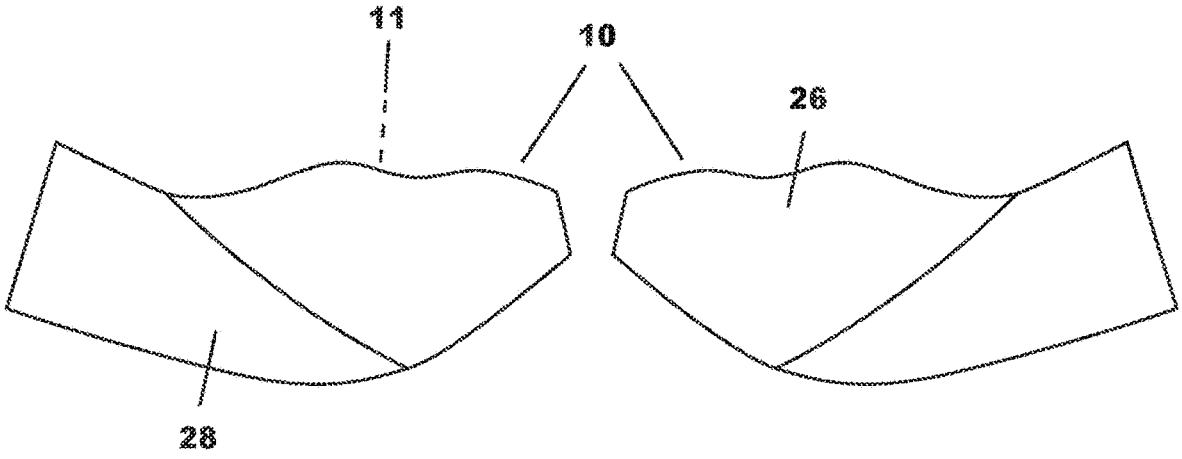

FIG. 15 is an example of an outer view of a completely laminated without paper liner two-piece embodiment of the dynamic function fashion tape 10 with right and left sides on a reduced scale as it touches the skin by the user. Not shown is the paper liner which is removed upon application. See FIGS. 6 and 6*a* for a cross section example of layers.

Figure 16:
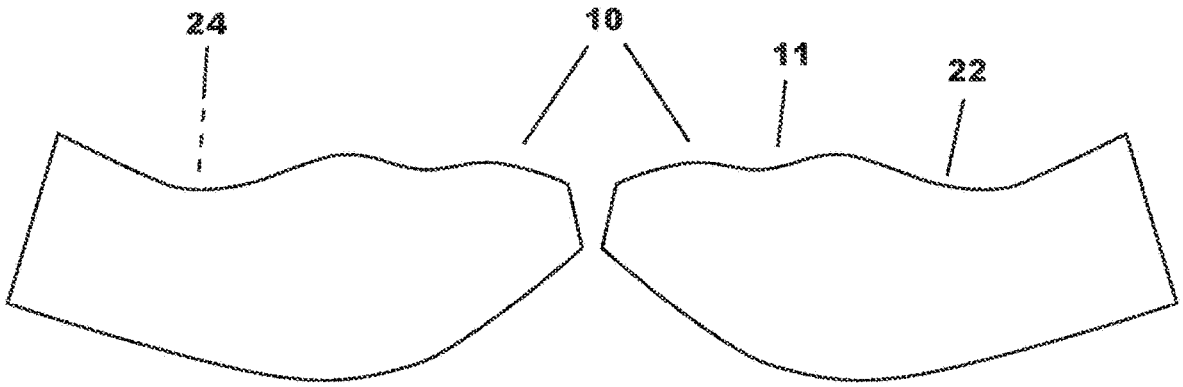

FIG. 16 is an example of an outer view of the assembled embodiment of the dynamic function fashion tape 10 in elastic fabric from the front as the user would see it.

Figure 17:
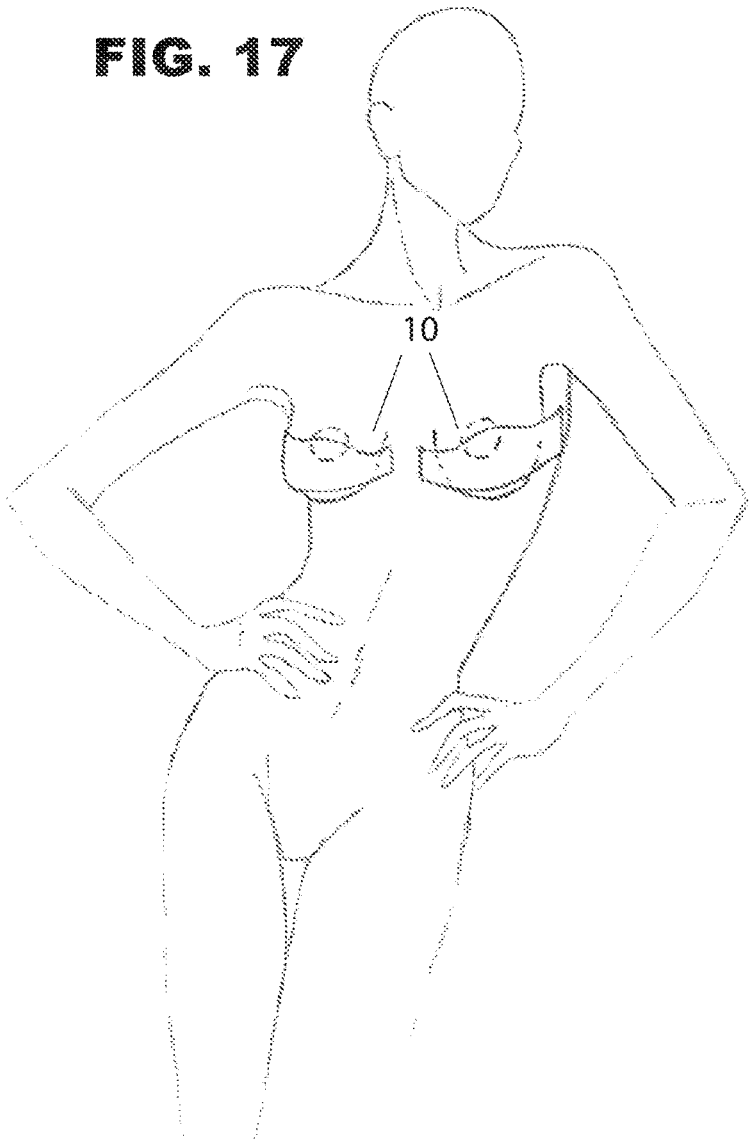

FIG. 17 is an example of the front view of an on-body sketch after applying both sides of the dynamic function fashion tape 10. The dashed lines are representing the areola and the breast tissue underneath the fashion tape 10.

Figure 18:
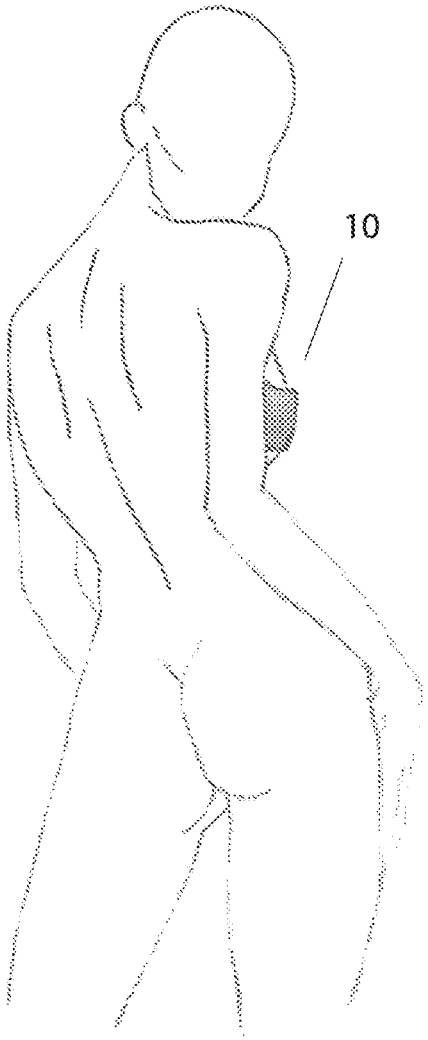

FIG. 18 is an example of the side and back view of an on-body sketch after applying both sides of the dynamic function fashion tape 10.

Figure 19:
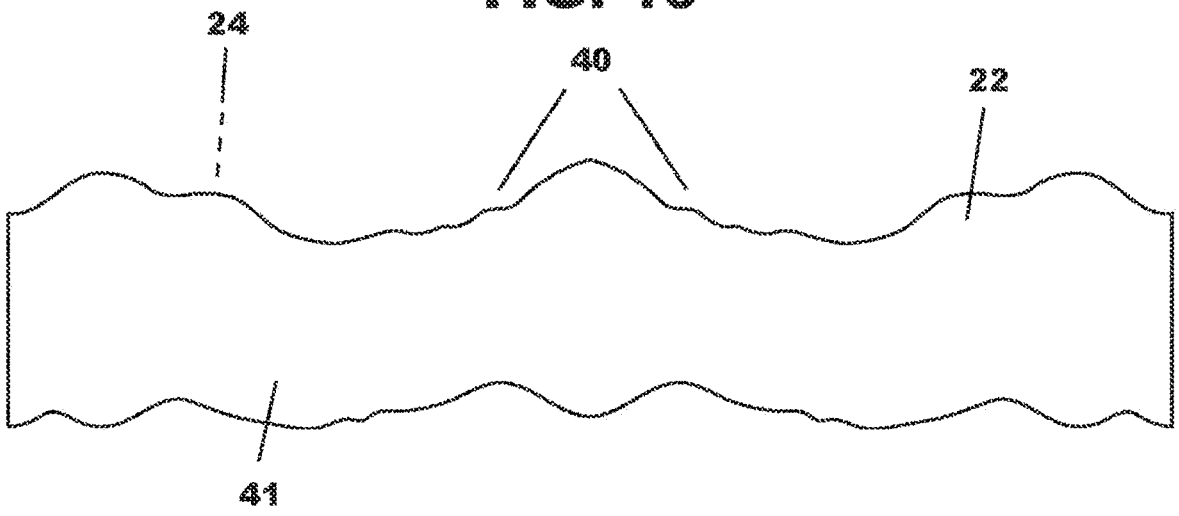

FIG. 19 is an example of an outer view of a one layer of an elastic lace one-piece embodiment of a dynamic function fashion tape 40 on a reduced scale.

Figure 20:
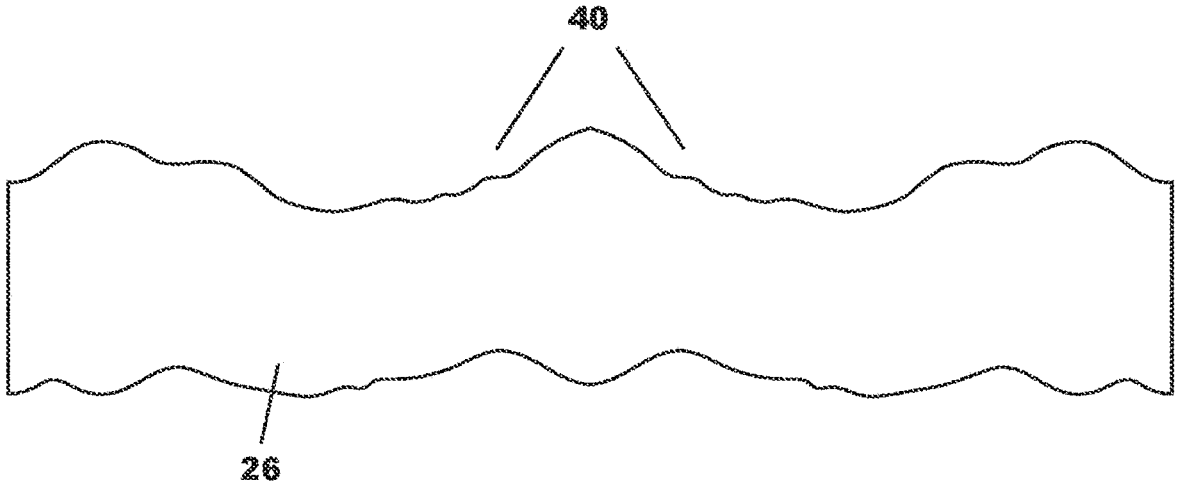

FIG. 20 is an example of an outer view of one layer of the inner body medical grade adhesive of the one-piece dynamic function fashion tape 40 on a reduced scale.

Figure 21:
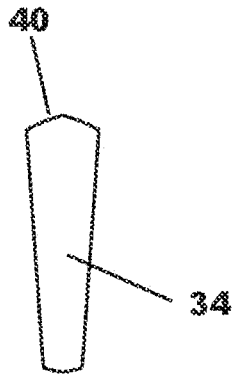

FIG. 21 is an example of an outer view of one layer of an inner front support medical grade adhesive of the dynamic function fashion tape 40 on a reduced scale.

Figure 22:
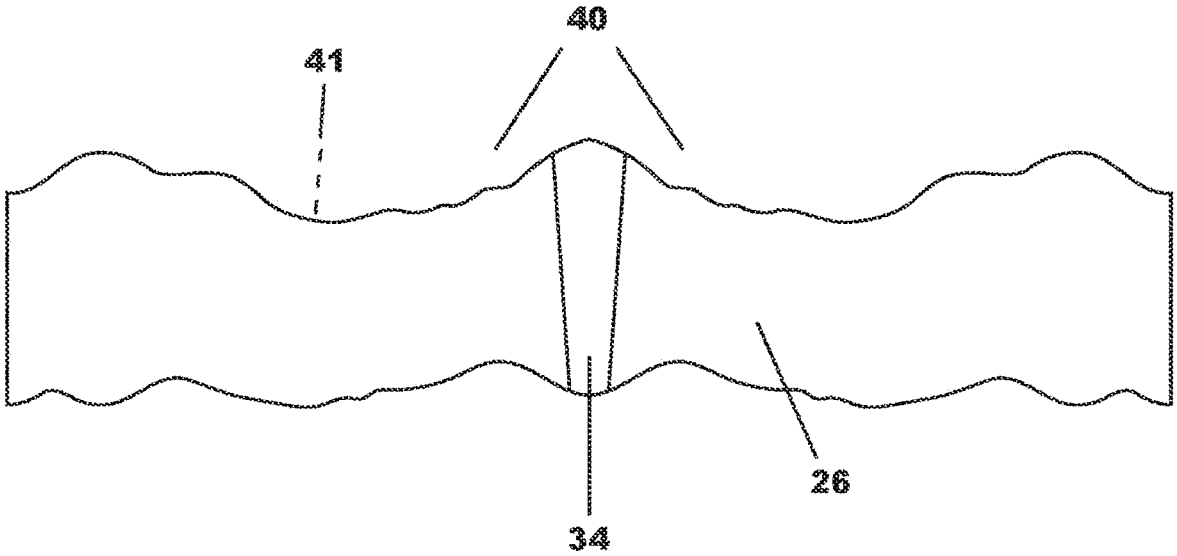

FIG. 22 is an example of an outer view of a completely laminated without paper liner one-piece embodiment of the dynamic function fashion tape 40 with right and left sides on a reduced scale as it touches the skin by the user. Not shown is the paper liner which is removed upon application. See FIGS. 6 and 6*a* for a cross section example of layers.

Figure 23:
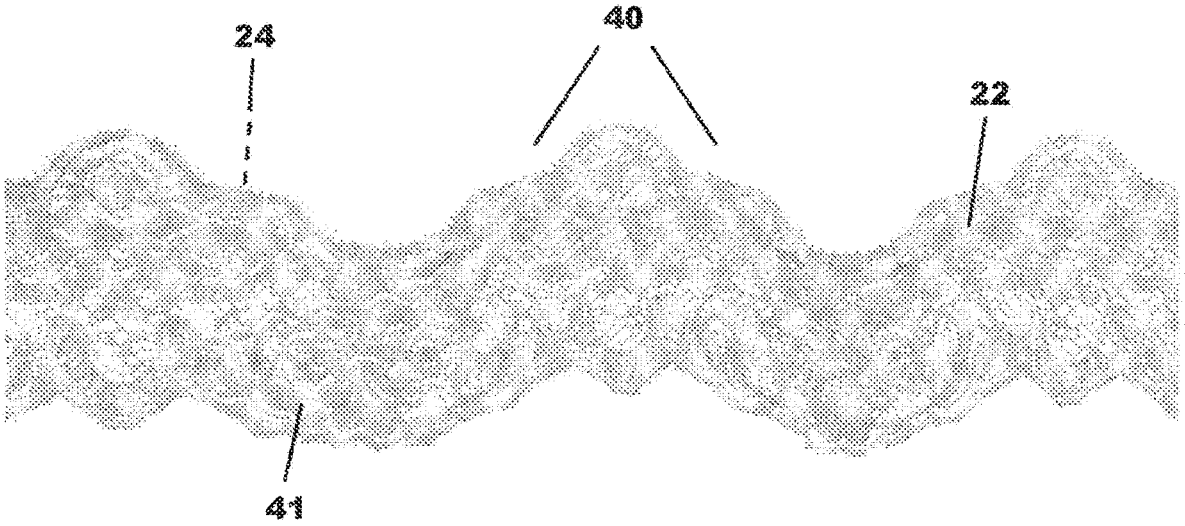

FIG. 23 is an example of an outer view of an assembled one-piece embodiment of the dynamic function fashion tape 40 in elastic lace on a reduced scale.

Figure 24:
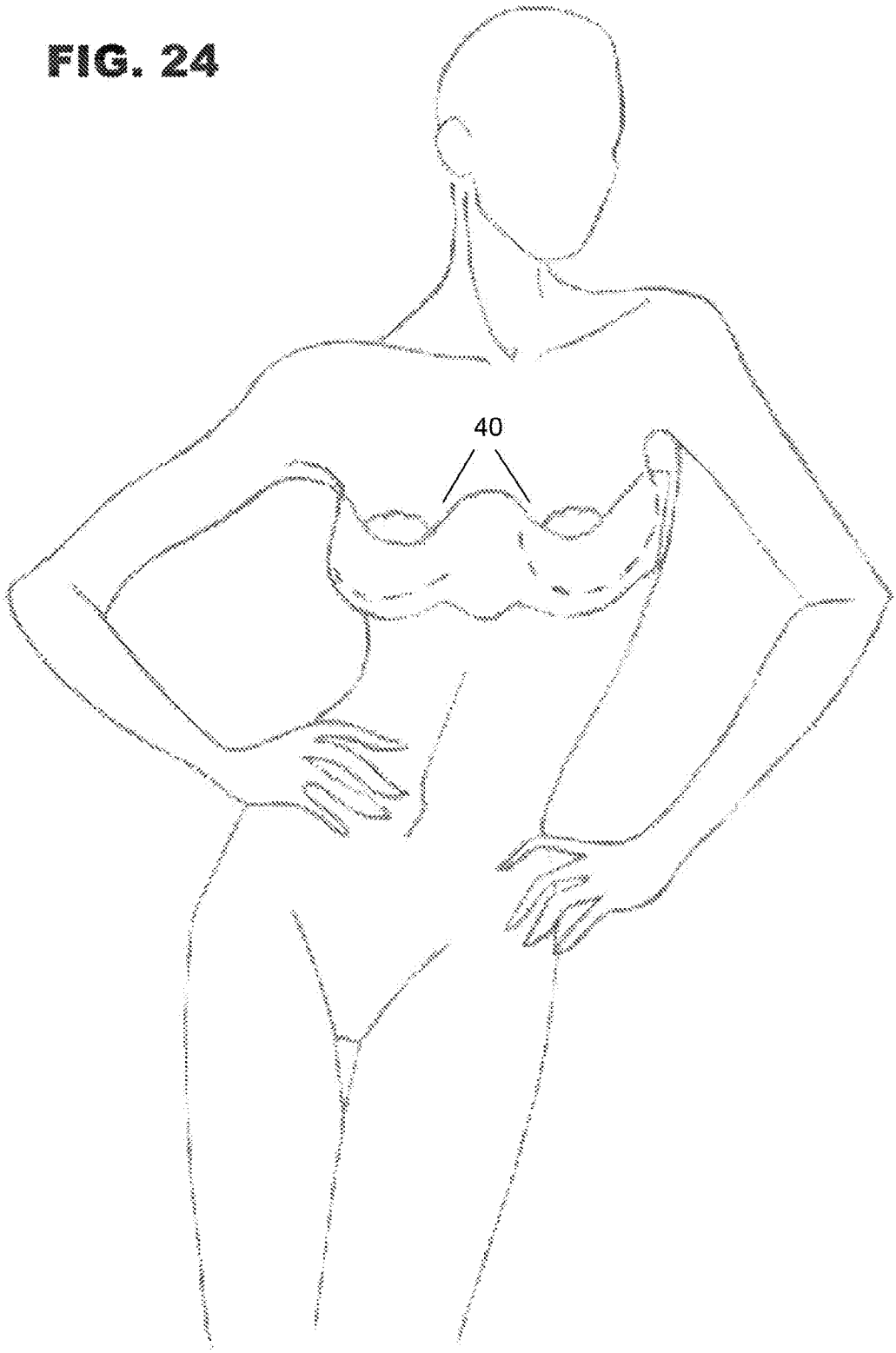

FIG. 24 is an example of an on-body sketch after applying the one-piece dynamic function fashion tape 40 worn as a breast cradling option and worn with a nipple cover for modesty in this sketch as one of my options.

Figure 25:
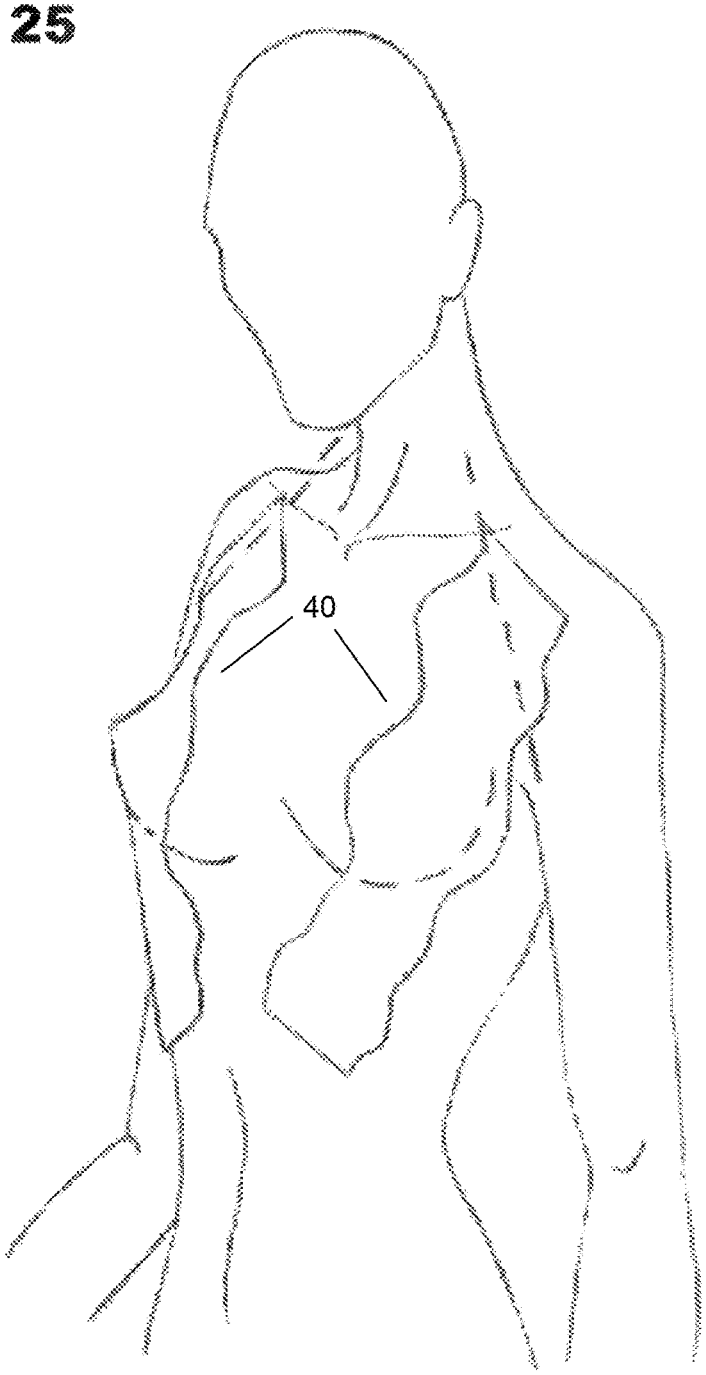

FIG. 25 is an example of an on-body sketch using two of the one-piece dynamic function fashion tape lace 40 worn as a pair on both sides of the breast and torso. Dashed lines on the shoulder area represent possible cut lines for style option, and dashed lines on breast tissue represent the tissue underneath the fashion tape 40.

5. DETAILED DESCRIPTION OF THE INVENTION

The present invention will now be described more fully herein with reference to the accompanying figures, in which preferred embodiments of the invention are shown. The invention, may however, be embodied in many different forms and should not be construed as limited to the embodiments set forth herein. Rather, these embodiments are provided so that this disclosure will be thorough and complete, and fully convey the scope of the invention to those skilled in the art.

The term "dynamic function" as used herein represents the force of the embodiment. It is the performance on the body with a certain controlled stretchability that creates lift and shape when recovering, which is referring to said modulus.

The term "fashion tape" as used herein represents the solution many have used trying to keep the breast in place and lifted without being revealed when wearing challenging outerwear pieces such as a gown, plunging necklines, a backless super elongated triangle style, a deep cut underarm and other skin revealing necklines and cutouts in clothing.

Figure 1:
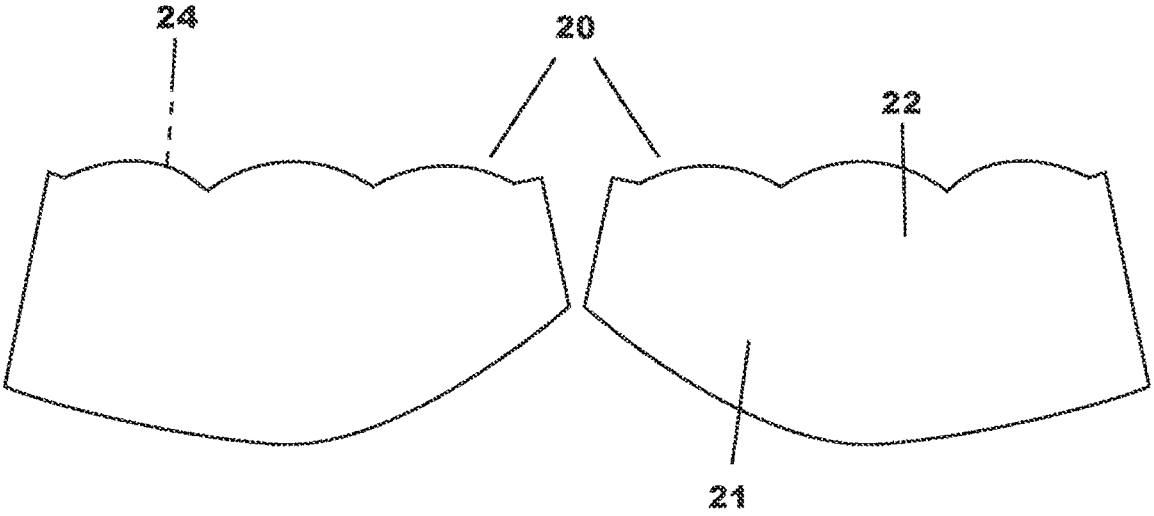
FIG. 1 is an example of an outer view of one layer of an elastic lace of a two-piece embodiment of a dynamic function fashion tape 20 with right and left sides on a reduced scale.
Figure 2:
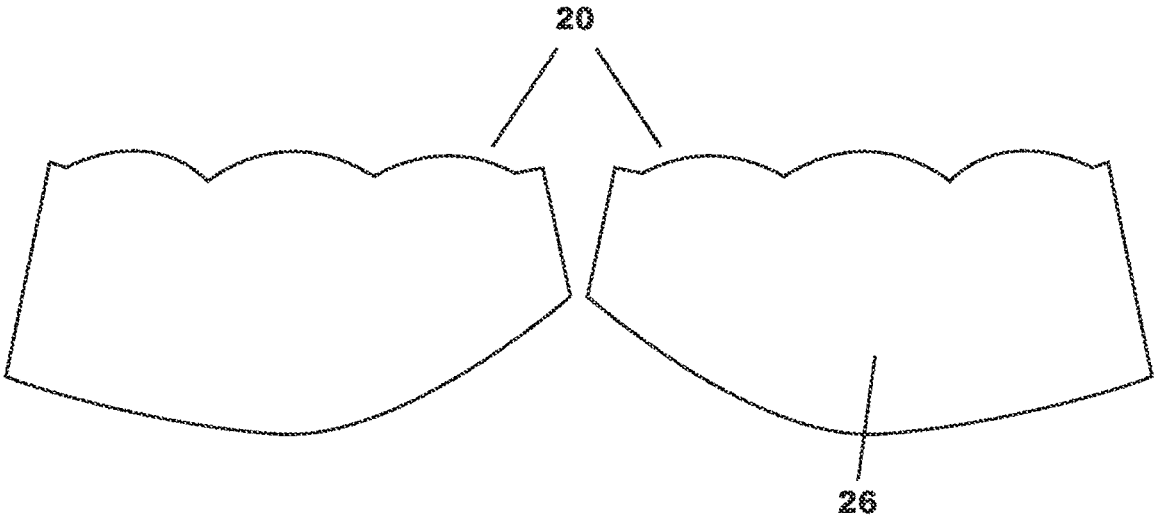
FIG. 2 is an example of an outer view of one layer of an inner medical grade adhesive of the two-piece embodiment of the dynamic function fashion tape 20 with right and left sides on a reduced scale.
Figure 3:
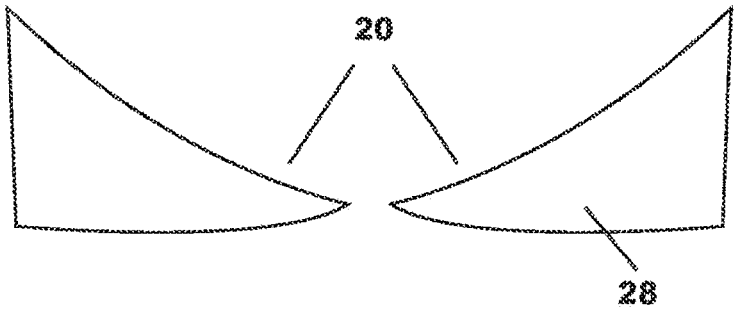
FIG. 3 is an example of an outer view of one layer of an inner medical grade adhesive side support of the two-piece embodiment of the dynamic function fashion tape 20 with right and left sides on a reduced scale.
Figure 4:
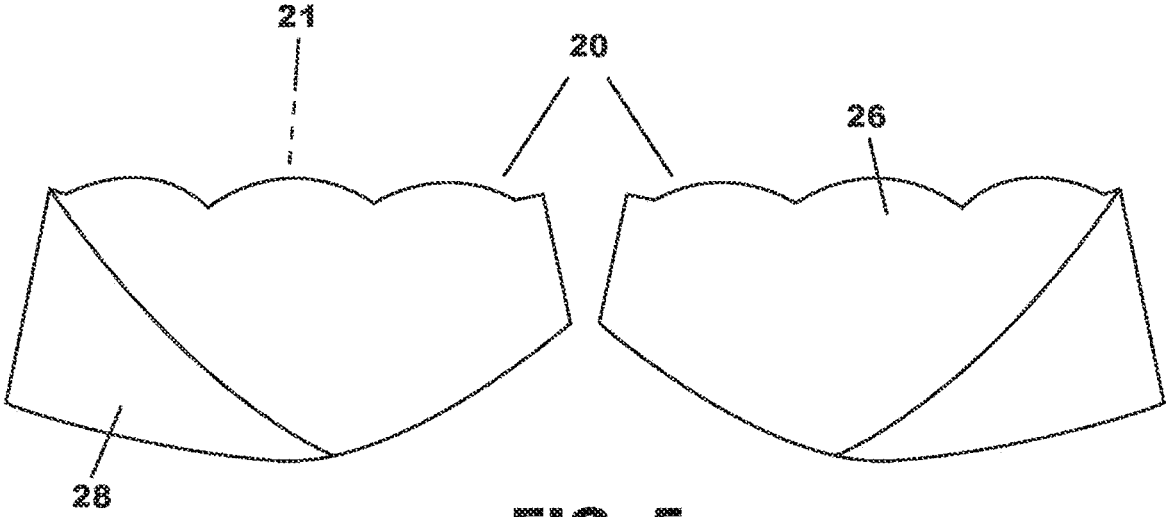
FIG. 4 is an example of an outer view of a completely laminated without paper liner two-piece embodiment of the dynamic function fashion tape 20 with right and left sides on a reduced scale as it touches the skin by the user.
Figure 5:
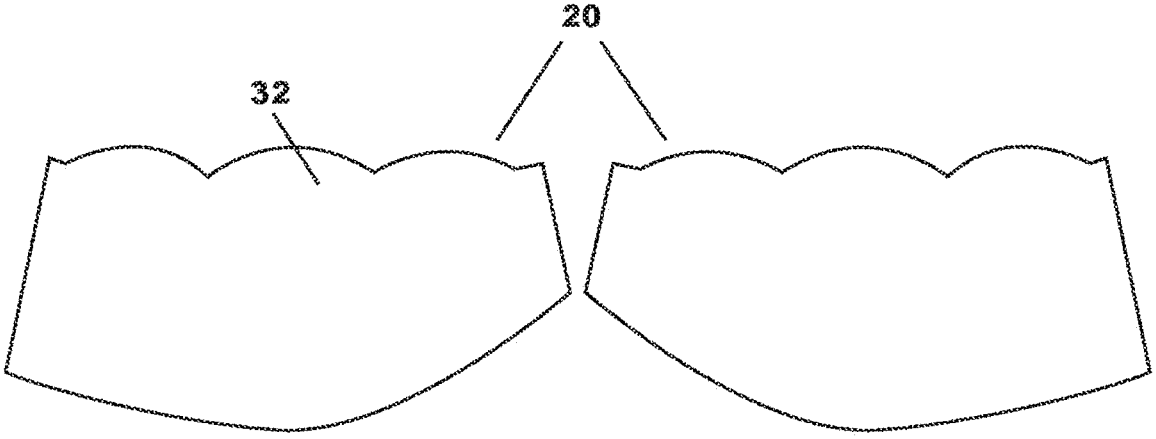
FIG. 5 is an example of an inner view, skin side of the two-piece embodiment of the dynamic function fashion tape 20 with the paper liner on a reduced scale.
Figure 6:
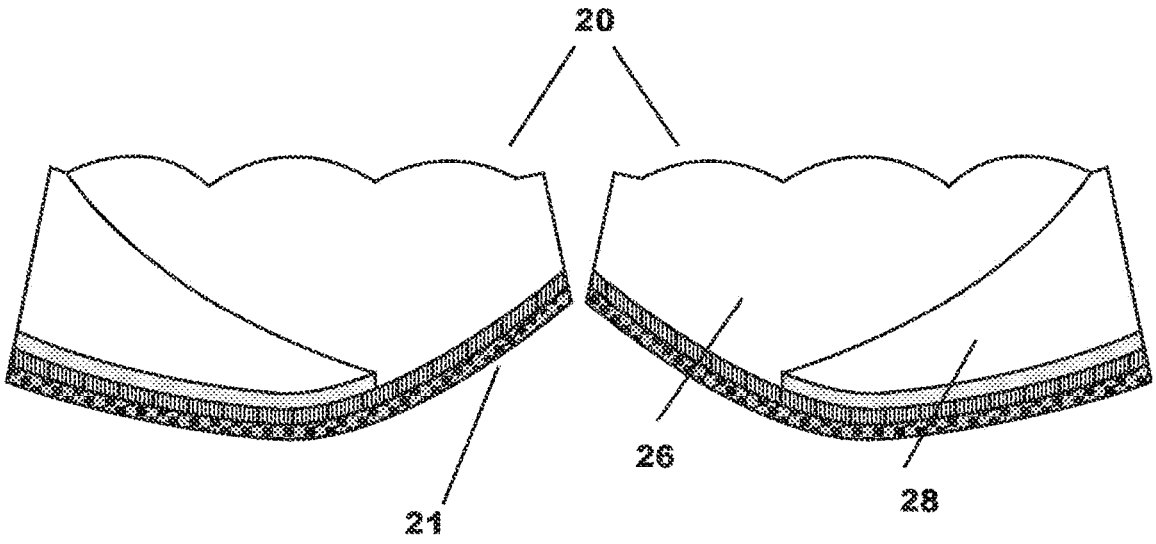
FIG. 6 is an example of the cross section of all layers laminated together without paper liner, creating the embodiment of the outer elastic lace layer, inner body medical grade adhesive layer, and inner side support medical grade adhesive layer, as used in the dynamic function fashion tape 20.
Figure 6A:
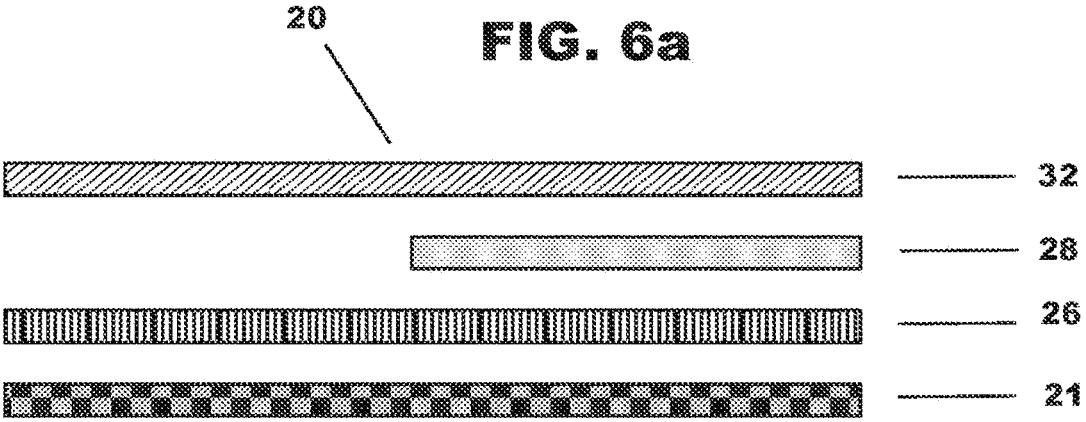

A better understanding of the present invention may be obtained from the following detailed description of the preferred embodiments described in connection with the accompanying drawings wherein:

FIG. 1 represents the first embodiment 20 of first layer made of elastic lace 21 with outer surface 22 and inner surface 24 of first layer 21 predisposed predetermined directionally placed. FIG. 2 represents the first inner body layer of embodiment 20 made of medical grade adhesive 26 predisposed predetermined directionally placed. FIG. 3 represents the second inner side support layer of embodiment 20 made of medical grade adhesive member 28 predisposed predetermined directionally placed. FIG. 4 represents all layers laminated together of embodiment 20 with first layer lace 21 with second layer medical grade adhesive 26 and with third layer medical grade adhesive 28. This FIG. 4 is shown without the backing layer of paper liner 32 for purpose of showing the layers of predisposed predetermined directionally placed lace and adhesive members. FIG. 5 represents the complete laminated embodiment 20 from the backing layer protective paper liner 32 point of view which is used to keep debris out before applying and to ensure proper function of the tape. FIG. 6 represents an example of the cross section of laminated layers with lace layer 21 with body medical grade adhesive layer 26 with additional support medical adhesive layer 28 shown without protective paper liner. FIG. 6*a* represents an example of the preferred order of placement of the combination of layers which may vary from embodiment to embodiment; cross section of laminated layers with lace layer 21 (or other flexible fabrics) with body medical grade adhesive layer 26 and additional support medical grade adhesive layer 28 (or other support layers) shown including protective paper lining layer 32. FIG. 7 represents an example of a final laminated lace version embodiment 20 ready to apply on the body.

Further explanation to the above detailed description in embodiment 20 the outer lace layer 21 is placed directionally on one grain line strategically placed intentionally providing support for the breast tissue combined with the inner body medical grade adhesive layer 26 shown in FIG. 2, which is placed on a different grain line strategically placed intentionally for additional lift support and projection for the user's breast tissue. Furthermore, an additional side support medical grade adhesive layer 28 represented in FIG. 3 is added with another directional grain line strategically placed intentionally therefore adding even more lift support and projection for the user's breast tissue.

Instructions to adhering and wearing the first embodiment of the present invention dynamic function fashion tape 20 on the breast tissue and torso area are listed here. Before and after on-body sketches are shown in drawing FIGS. 8 through 11.

To apply embodiment 20, the user will begin by removing paper lining layer 32 from one of the pair either right or left side of the two-piece embodiment 20. Step two the wearer should hold the breast tissue up with their free hand while applying the tape with the other hand. Step 3 start from the outer side at the underarm, applying across the bust line and finish adhering with the inner side at the center of the wearer's sternum. Applying the tape to the farthest outer portion of one breast near the underarm and finishing at the center front sternum this will achieve the best lift and projection of the wearer's breast tissue. Repeat these steps on the opposite breast.

FIG. 11 is an example of the side view of the on-body sketch after applying dynamic function fashion tape 20. The dashed lines in the drawing represent breast tissue underneath to show placement on the wearer's breast and infra-mammary fold.

The dynamic function fashion tape 20 providing a demi or balconet look of a bra silhouette is smooth and conforming to the body while creating the desired shape. The user will love how comfortable, feminine, and natural they will look with a soft projected and lifted breast tissue. The ease of movement and freedom from not having to wear a traditional bra will be very enjoyable to the user. The user will enjoy a wireless backless frameless strapless scooping breast volume device as it is truly a two-dimensional (2D) device that transforms and performs as a three-dimensional (3D) device.

The second embodiment of the present invention, dynamic function fashion tape 10 is a two-piece cup version like said lace dynamic function fashion tape 20 but in a fabric combination and slightly different design lines and shape to represent the variety of endless possibilities in the methodology.

FIG. 12 represents the first layer of second embodiment 10 made of elastic fabric 11 with outer surface 22 and inner surface 24 of first layer 11 predisposed predetermined directionally placed. FIG. 13 represents the first inner body layer of embodiment 10 made of medical grade adhesive member 26 predisposed predetermined directionally placed. FIG. 14 represents the second inner side support layer of embodiment 10 made of medical grade adhesive member 28 predisposed predetermined directionally placed. FIG. 15 represents embodiment 20 of the complete laminated embodiment with first layer in elastic fabric 11 with second layer in medical grade adhesive layer 26 and with third layer in medical grade adhesive 28. Not shown is the paper backing liner 32 that is used to keep debris out and secure proper function of the tape as illustrated in FIG. 5. FIG. 6*a* represents an example of the cross section of complete laminated layers, with outer flexible textile layer representing different textile cover layers used depending on embodiment. FIG. 16 represents an example of an outer fabric as the final laminated second embodiment 10 before applying on the body. The user will apply embodiment 10 as the same application as embodiment 20 as FIG. 8-11 and the user can vary the areola being shown or covered depending on breast tissue size and preference. FIG. 17 represents embodiment 10 on a user's body from the front after applying. Dashed lines represent areola partially covered and breast tissue underneath embodiment 10. FIG. 18 represents embodiment 10 on a user's body from the side and back view after applying.

The dynamic function fashion tape 10 performs and feels like a second skin controlling the body's shape and movement in an ideal healthy way like the dynamic function fashion tape 20. It lifts and re-shapes the breast tissue in a feminine natural look, is very comfortable breathable body temperature neutral and light weight, the user may forget they are wearing it with the smooth surface underneath clothing being so enjoyable.

The third embodiment of the present invention dynamic function fashion tape 40 is a one-piece cup version like lace dynamic fashion tape 20 in performance features and methodology but in an elastic lace one-piece combination and slightly different design lines and shape to represent the variety of endless possibilities in the methodology. For example, the one-piece dynamic function fashion tape 40 can be worn singularly or in pairs as desired by the user. All dynamic function fashion tape embodiments can be worn layered or in various combinations as desired by the user with endless possibilities of application of the methodology.

FIG. 19 represents the first layer of third embodiment 40 made of elastic lace 41 with outer surface 22 and inner surface 24 of first layer 41 predisposed predetermined directionally placed. FIG. 20 represents the first inner body layer of third embodiment 40 made of medical grade adhesive member 26 predisposed predetermined directionally placed. FIG. 21 represents the second inner center front support layer of third embodiment 40 made of medical grade adhesive 34 predisposed predetermined directionally placed. FIG. 22 represents all layers laminated together of embodiment 40 with first layer in elastic lace 41 with second layer in medical grade adhesive 26 and with third layer in medical grade adhesive 34. This FIG. 22 is shown without the backing layer of paper liner 32 for purpose of showing the layers of predisposed predetermined directionally placed lace and adhesive members. FIG. 6*a* represents an example of the cross section of laminated layers, with flexible textile layer representing different textile cover layers used depending on embodiment and body adhesive layer and additional support adhesive layer representing different additional support members depending on embodiment, shown including protective paper liner layer. FIG. 23 further represents an example of the outer lace as the final third embodiment 40 before applying on the body.

FIG. 24 is an example of a one-piece version of dynamic function fashion tape lace 40 worn cradling both breast tissues with nipple cover shown for modesty, and dashed lines shown for representing the breast tissue underneath fashion tape 40. In this FIG. 24, the user is starting at the sternum applying fashion tape 40 across one breast tissue while holding breast tissue to desired height to the underarm and then repeating the same steps on other side. FIG. 25 is an example of a one-piece lace version of dynamic function fashion tape 40 worn in a pair on both sides of the breast and torso with very deep plunge outerwear. The dashed lines on the breast tissue represent where the breast tissue most probably is located underneath fashion tape 40 depending on breast tissue volume and desired placement. The dashed lines at the neckline and armhole represent a possible cut line and easily trim for adjustment. In this FIG. 25, the user is starting at the lower portion of the torso waistline area with one of the pieces of fashion tape 40 and applying it going up the torso holding the breast tissue up and into the desired height applying over the tissue on the outer side of breast tissue at underarm and end at the shoulder area depending on the desired neckline placement. Can be trimmed before applying. Repeat on the second side or as desired.

There are one piece and two-piece variations that can be used. The third embodiment, dynamic function fashion tape 40 is a one-piece embodiment that can be worn cradling the breast tissue from one breast to the other including both breast tissue areas. It can also be worn from neckline or shoulder area down along the underarm and the side of the breast or underneath the breast. The user can also wear it on the side of the breast toward the back, or in combination of any of the above. Many possibilities of applying the two-piece and one-piece embodiments together and/or separately, depending on the user's needs and desires. These examples are a great solution to wearing a strapless bra without the feeling of wanting to pull it up all day long because it naturally adheres to the breast tissue and torso areas. It eliminates a support frame and fastener. Traditional strapless bras also have very strong elastics with hot, uncomfortable silicone attached to the elastic. The silicone is also not breathable and irritates many users' skins while wearing including some having allergic reactions and all of this is eliminated with the present embodiments.

The present invention and methodology may provide lift smoothing and slimming benefits without the unsightly view of a bra, shape wear or other garments. The user can also wear multiple pairs of the present invention and layer them in different areas of their body for lift support and smoothing. The user can create their own silhouette and body art. There are endless combinations to create a solution to wearing traditional bras, lingerie, and other innerwear and outerwear garments. The present invention and methodology are made in pretty colors, fabrics, and laces, it lifts the user's breasts and spirit making you feel feminine while wearing and free of restriction. The opportunity and possibility to cover a large range of breast sizes, shapes and volume is endless, no matter if the breast is very different in size from left to right, or if the user had a mastectomy.

The present invention began as a replacement of a bra and has been further developed into a replacement for shape wear and solution garment options and a methodology of strategically designed dynamically functioning solutions. Additionally, it can be a replacement for swim, active, inner, and outer wear garments and accessories depending on the style of dynamic function fashion tape worn by the user.

The user will love how comfortable, feminine, and natural they will look with a soft projected and lifted breast tissue. The ease of movement and freedom from not having to wear a traditional bra will be very enjoyable to the user. Traditional bras have elastics, straps, underwire, support frame, and hardware that many find uncomfortable particularly larger breasted people. The user will also be able to enjoy wearing many different types of clothing with the present invention and methodology because of the lack of underwire, bra straps, support frame and a tight back. The user's body will move more freely, and user will feel healthier, and more feminine with the alternative to wearing a bra in the present invention and methodology.

The present invention and methodology lifts and reshapes the breast tissue ideally, smooths body tissue in a healthy way, is very comfortable breathable body temperature neutral and light weight, the user may forget they are wearing it, is easy to apply, can wear continuously for up to 10 days during light physical activities, it is waterproof and showerproof, it is a non-surgical breast lift, and provides breast projection without underwire or any other harmful, rigid force around the tissue that would achieve some kind of uncontrolled projection. The present invention and methodology are a wireless backless frameless strapless scooping breast volume device. It is truly a two-dimensional (2D) device that transforms and performs as a three-dimensional (3D) device.

All illustrations of the drawings are for describing selected embodiments and are not intended to limit the scope of the claims. The specifications describe a dynamic function fashion tape 20, dynamic function fashion tape 10 and dynamic function fashion tape 40 as applied to breast tissue. However, the inventive dynamic function fashion tape design and methodology may be used in any application in which the user may benefit from and/or require projection lift support and/or concealing shaping smoothing of breast tissue and/or other body tissue.

Others have invented fashion tapes that are difficult to apply, and don't perform easily or in a satisfying way. The present invention of fashion tape is dynamically functioning and dynamically performing because of the various aspects and advantages of the present methodology. It is a well-researched and well-tested, solution and high-performance driven methodology that provides controlled projection fit lift and ultimate comfort due to consciously selected materials and components that are strategically placed to create reinforced power zones.

The present invention is not to be limited in scope by the embodiments disclosed in the examples which is intended as illustrations of the aspect of the invention and the methodology which are functionally equivalent are within the scope of the invention. Various modifications of the invention in addition to those shown and described herein will become apparent to those skilled in the art from the foregoing description. Such modifications are intended to fall within the scope of the appended claims. It is realized that other variations and modifications of the embodiments listed are possible without departing from the scope and spirit of the present invention. Those skilled in the art will recognize or be able to ascertain using no more than routine experimentation, any equivalents to the embodiments described herein. Such equivalents are intended to be encompassed by the claims.

What is claimed is:

1. A human body support tape, the tape being a human body-worn fashion tape to lift and support body areas of a human wearer, the tape comprising:

at least one first flexible textile layer having an inner surface and an outer surface, said first flexible textile layer being configured for placement on a first grain line of the first flexible textile layer to provide power and force for supporting the body tissue of the wearer;

at least one first adhesive layer having an inner surface and an outer surface, said first adhesive layer being configured for placement on a second grain line, the second grain line being the same and/or different from the first grain line, to provide additional force, power, and recovery for sculpting of the body tissue of the wearer, said first adhesive layer being laminated to said inner surface of the first flexible textile layer; and at least one second adhesive layer having an inner surface and an outer surface, said second adhesive layer being configured for placement on a third grain line, the third grain line being the same and or different from the first grain line and the second grain line, to provide further force, power, and recovery for supporting the body tissue of the wearer, said second adhesive layer being laminated to said inner surface of the first adhesive layer, wherein said first adhesive layer and said second adhesive layer are attached to a first paper liner layer to protect the first and second adhesive layers from debris, thereby keeping said first and second adhesive layers clean.

2. The human body support tape of claim 1, wherein the tape is at least one piece.

3. The human body support tape of claim 1, wherein each of the at least one first adhesive layer and the at least one second adhesive layer is made of a medical grade adhesive.

4. The human body support tape of claim 1, wherein each of the at least one first adhesive layer and the at least one second adhesive layer is waterproof.

5. The human body support tape of claim 1, wherein the at least one first adhesive layer and the at least one second adhesive layer is configured for repeat skin contact up to 10 days consistent duration and is environmentally friendly.

6. The human body support tape of claim 1, wherein the at least one first adhesive layer and the second adhesive layer is hypoallergenic.

7. The human body support tape of claim 1, wherein inner surface is configured to be placed on at least one body tissue area or inner garment to lift, sculpt, project, and/or support the wearer's body tissue.

8. The human body support tape of claim 1, wherein the tape is designed for fashion applications, apparel and non-apparel applications, body art applications, body tissue applications, body sculpting applications, and high-performance support applications.

9. A method of manufacturing a human body support tape:

providing a first flexible textile layer;

laminating a first adhesive layer to an inner surface of the first flexible textile layer in a predetermined grain line orientation;

laminating a second adhesive layer to an inner surface of the first adhesive layer in a second predetermined grain line orientation; and cutting the laminated first and second adhesive layers into a desired shape such that the resulting tape conforms, sculpts, projects, and supports the natural shape of body tissue.

10. The method of claim 9, wherein the tape transitions from a flat 2-dimensional configuration to a contoured 3-dimensional configuration when applied to the body tissue of a wearer.

* * * * *